US008033414B2

(12) United States Patent
Conforti

(10) Patent No.: US 8,033,414 B2
(45) Date of Patent: Oct. 11, 2011

(54) ODOR CONTAINMENT

(76) Inventor: Carl J Conforti, Fall River, MA (US)

( * ) Notice: Subject to any disclaimer, the term of this patent is extended or adjusted under 35 U.S.C. 154(b) by 350 days.

(21) Appl. No.: 12/221,142

(22) Filed: Jul. 31, 2008

(65) Prior Publication Data

US 2009/0034886 A1 Feb. 5, 2009

Related U.S. Application Data

(62) Division of application No. 10/796,438, filed on Mar. 8, 2004, now abandoned.

(60) Provisional application No. 60/452,803, filed on Mar. 7, 2003.

(51) Int. Cl.
*B65D 25/14* (2006.01)
*B65D 35/14* (2006.01)
*B65D 90/00* (2006.01)

(52) U.S. Cl. ..... 220/495.06; 220/495.05

(58) Field of Classification Search ..... 220/481, 220/495.01, 495.03, 495.05, 495.06, 495.11; 248/98, 101; 211/85.15
See application file for complete search history.

(56) References Cited

U.S. PATENT DOCUMENTS 4,948,639 A * 8/1990 Brooker et al. ..... 428/35.2
5,799,818 A * 9/1998 Ringer ..... 220/62.21
6,390,323 B1 * 5/2002 Alticosalian ..... 220/495.03
6,398,411 B2 * 6/2002 Metzger ..... 383/33

* cited by examiner

*Primary Examiner* — Anthony Stashick
*Assistant Examiner* — Harry A Grosso

(57) ABSTRACT

An odor-containment system for use with a flexible bag and a receptacle for holding waste items includes a body configured to be connected to the receptacle for holding waste items, the body providing a passageway through the body, and a plurality of sealing members attached, directly or indirectly, to the body and disposed across the passageway, the sealing members being disposed adjacent to each other in a static, closed position of the system such that a flexible bag inserted between the sealing members will be forced closed, where the body is configured to cover an opening of the receptacle for receiving the waste items, where the sealing members are attached to the body such that the sealing members can separate from each other to permit one of the waste items to be inserted between the sealing members, and where the sealing members are biased toward the static, closed position with the sealing members adjacent to each other such that when a waste moves out from between the sealing members, the sealing members will return to their static positions adjacent to each other.

18 Claims, 12 Drawing Sheets

ODOR CONTAINMENT

CROSS-REFERENCE TO RELATED ACTIONS

This application claims the benefit of U.S. Provisional Application No. 60/452,803 filed Mar. 7, 2003, and non provisional Ser. No. 10/796,438 filed Mar. 8, 2004 now abandoned the contents of which are incorporated here by reference. This continuing application is filed as a divisional of non provisional Ser. No. 10/796,438.

FIELD OF THE INVENTION

This invention relates to odor containment and more particularly to apparatus for storing and/or transporting products or materials that may produce undesirable odors.

BACKGROUND OF THE INVENTION

People generate literally tons of items that can produce undesirable odors. Often trash is stored within waste receptacles and other enclosures for a period of time before it is secured and transferred to a secondary trash receptacle to be collected by waste management companies. In some instances products are even disposed of in a manner that may not be environmentally safe and/or appealing to the public. Consumer waste and other related disposable products often generate unappealing or undesirable odors after a period of time. The undesirable odors are commonly produced from spoiled foods, dirty diapers and other waste-related products that may even be unsafe if left open or partially closed environment. Some products may also produce odors after a period of time when exposed to heat or other conditions that may cause accelerated food decay or can break down and create bacteria and other living organisms that are unhealthy to the surrounding environment.

Because odor-producing items are frequently stored where peopled can smell the odors produced, e.g., in kitchens, nurseries, etc., and are stored for periods of time, e.g., days, before being removed, it is desirable to try to reduce odors. Some devices are available that try to limit release of the odors. There are also products available that try to mask the odors, such as air fresheners.

There are many different types of trashcans available that in some way attempt to inhibit proliferation of undesirable odors. Typical trashcans have an open bag disposed a container, and a lid that can be pivoted to provide access to the bag. With such trashcans, however, an open end of the bag exposes the contents of the bag to the surrounding environment while the lid is open, and exposes the contents to the lid while the lid is shut. Further, opening and closing of the lid causes odors from articles in the bag to be distributed (e.g., due to a vacuum produced while opening a lid, or by pushing air while closing the lid). Also, the articles may contaminate the outside surface of the can and overtime create odors and undesirable appearance on the system itself (e.g., on the inside of the lid).

There are several types of flexible film bags found in today's market that, if of a reasonable thickness, can reduce the amount of odor that permeates through the film from the inside of the bag to the surrounding environment. These bags are typically made of LDPE (Low Density Polyethylene) and HDPE (High Density Polyethylene) and allow the bag to be carried while holding disposed articles and offer some type of barrier property to reduce odors. These bags can be manufactured with an additive to provide a scent that may help mask the odor of the articles stored or disposed. There are bags or containers that are made of a laminate material, and a layer of rigid film and semi rigid or flexible (ethylene film) structure to provide a vapor barrier. Container of this sort may be manufactured to be disposable, i.e., thrown away after use.

In order to try to contain odors, there have been several devices developed and marketed within consumer and industrial markets. Consumer products are sold that have a simple thin flexible film bag, and a molded plastic rigid housing to keep the product contained during use. Often the articles disposed in the products contaminate the molded plastic component and over time this generates an undesirable odor and/or frequently requires cleaning. There are other devices that are sold with custom refills that require the device to use a specific bag that is not a standard size or component and the consumer-would require both components (i.e. the bag and the plastic housing) to make the system functional.

There are some materials that have a multi-layer structure comprising a polyethylene (PE), a secondary layer of polyester (PET), and even multiples thereof to form a bag or container. However, with these bags and containers, ethylene provides a poor vapor transmission property and requires a very thick layer of material to improve the barrier properties but is neither cost effective nor does it offer a sealed containment system. Furthermore, in the case of a bag made with multiple layers as described above, the device may not be able to be conveniently stored or economically produced.

SUMMARY OF THE INVENTION

In general, in an aspect, the invention provides an odor-containment system for use with a flexible bag and a receptacle for holding waste items, the system including a body configured to be connected to the receptacle for holding waste items, the body providing a passageway through the body, and a plurality of sealing members attached, directly or indirectly, to the body and disposed across the passageway, the sealing members being disposed adjacent to each other in a static, closed position of the system such that a flexible bag inserted between the sealing members will be forced closed, where the body is configured to cover an opening of the receptacle for receiving the waste items, where the sealing members are attached to the body such that the sealing members can separate from each other to permit one of the waste items to be inserted between the sealing members, and where the sealing members are biased toward the static, closed position with the sealing members adjacent to each other such that when a waste moves out from between the sealing members, the sealing members will return to their static positions adjacent to each other.

Implementations of the invention may include one or more of the following features. The system further includes the flexible bag, where the flexible bag is configured to self-seal. The flexible bag is configured to at least one of adhere to itself and statically bond to itself. The system further includes the flexible bag, where the flexible bag is configured to at least one of produce an odor-masking scent, absorb odors, and neutralize odors. The system further includes the receptacle and a fullness indicator configured to provide at least one indication of a fullness of the receptacle. The fullness indicator comprises a pivot arm coupled to the receptacle and configured to point toward a first indication while waste in the receptacle reaches less than a threshold height and to move to point toward a second indication if waste in the receptacle reaches at least the threshold height.

In general, in another aspect, the invention provides an odor-containment apparatus including a body configured to receive and store odor-producing articles, the body having first and second ends, the second end being closed to retain the odor-producing articles in a chamber defined by the body, the body being made of a material configured to inhibit odor from passing through the body, at least a portion of the body spanning a first area in an open position, and an odor-inhibiting sleeve defining a through passage, the sleeve having a first end connected to the first end of the body, and having a second end that spans a second area in an open position, the second area being smaller than the first area, the second end of the sleeve providing an opening such that the passage of the sleeve is in fluid communication with the chamber defined by the body with the sleeve and the body in open positions, where the sleeve is configured to repeatedly attach to itself, at least on an inner surface, to self-seal the passage thereby inhibiting odors in the chamber defined by the body from passing through the sleeve, and where the sleeve is configured to detach from itself to allow an article to pass through the sleeve into the chamber of the body, and to re-attach to itself after the article passes through the sleeve.

Implementations of the invention may include one or more of the following features. The second end of the sleeve is disposed between the first and second ends of the body. The sleeve is configured to at least one of produce an odor-masking scent, absorb odors, neutralize odors, kill bacteria, and inhibit bacteria growth. The sleeve contains material configured to, be activated by at least one of heat, pressure, and time to release an odor-masking scent. The apparatus further includes an attaching mechanism connected to the body and configured to attach to a trash receptacle and to hold the apparatus in place as waste articles are deposited in the body through the sleeve. The body and the sleeve are portions of a monolithic material.

In general, in another aspect, the invention provides an odor-containing apparatus including a body configured to receive and store odor-producing articles, the body being of a material configured to resist odors passing through the body, the body providing an opening sized and shaped to receive the odor-producing articles, and a flap connected to the body to be disposed about the opening provided by the body and to allow the nap to move away from the opening, the flap being configured to releasably and repeatedly attach to the body about the opening provided by the body, where odors are inhibited from escaping from an interior of the body through the opening while the flap is attached to the body about the opening.

Implementations of the invention may include one or more of the following features. The flap comprises at least one of a rigid material, a semi-rigid material, a semi-rigid member coupled to a flexible material, a semi-rigid member embedded in a flexible material. The flap is connected to the body to return to being disposed about the opening after being moved away from the opening. The body is configured to attach to the nap to seal the opening.

In general, in another aspect, the invention provides a disposable odor-containment bag including a material that is configured to stretch and to adhere to itself, the bag having an open end providing an opening for receiving articles, a closed end, and a substantially tubular-shaped midsection connecting the open end and the closed end, where the midsection is configured to stretch to receive articles deposited through the open end and to self seal by adhering to itself to close the midsection to form an intermediate closure disposed between the closed end and the open end.

Embodiments of the invention may provide one or more of the following capabilities. Disposable odor containment apparatus may be provided, e.g., such that they may be disposed of in their entirety after use. Odors from articles can be contained using, a low cost, durable device that needs little or no assembly. Odors can be contained using a thin layer of flexible film that is able to carry a load. An odor containment apparatus can be provided that is easier to use than existing devices and/or has fewer components than existing devices. An odor containment apparatus can be provided that can attach to an existing receptacle, e.g., a kitchen trash can or wastepaper basket. Overfilling of trash bags may be guarded against, e.g., thereby reducing instances of spilling waste or tearing a trash bag due to the level of waste in the bag before being removed for disposal. An odor-containment apparatus can be provided that is inexpensive to manufacture aid/or has a relatively simple mechanical design. An odor containment device may be automatically sealed. An odor containment apparatus may be child-resistant, inhibiting children from accessing articles disposed in the apparatus. Indications of fullness of an odor containment system may be provided. Odor containment systems may be produced at relatively low costs. Odor containment systems can contain, mask, neutralize, and/or absorb odors, and/or fight bacteria (e.g., kill bacteria and/or inhibit bacteria growth). Odor-masking scents may be released in response to heat or mechanical activation. Odor containment apparatus may be conveniently carried and/or mounted to various items such as car interiors, walls, or cribs. An odor-containing apparatus may be made using an inline process using and upper and lower layer of film. Graphics or characters can be provided on a body of an odor-containment device, e.g., for promotions or advertising. Odor containment apparatus can be provided where articles to be disposed of are inhibited from contacting portions of a housing of the apparatus. Odor containment apparatus may be provided that require little or no setup, no special rigid support or outer-container, and no other means to activate the seal other than dropping an article inside the receiving end and allowing it to pass into the inner odor free containment portion of the bag or body. Odor-producing articles may be sealed without using a secondary component, e.g., a twist tie, and/or without requiring further action by a user, e.g., twisting and/or tying a bag, when a bag is full and ready for disposal. Odor containment apparatus can fit into relatively small areas, providing convenient means for disposing of waste in a variety of locations. For example, odor containment devices in the range of less than about 12" may be provided.

Embodiments of the invention may be used in a wide variety of applications for containing odors generally with consumer waste and food products. Food products can generate odors over a period of time and produce unhealthy conditions when exposed to heat and humidity. Embodiments of the invention may provide receptacles for food or other odor producing articles and consumer waste. These and other capabilities of the invention, along with the invention itself, will be more fully understood after a review of the following figures, detailed description, and claims.

DETAILED DESCRIPTION OF PREFERRED EMBODIMENTS

Embodiments of the invention provide techniques for containing odor-producing items while inhibiting proliferation of the produced odors. An odor-containment apparatus may provide a storage capacity and an odor barrier. The apparatus preferably includes a flexible, e.g., plastic, bag or other container that is configured to adhere to itself and/or another portion of the container, yet repeatedly allow odor-producing articles to pass between portions that adhere to each other. For example, a self-adhering bag may be pushed together by bias members, e.g., springs, yet allow articles to be inserted between portions that adhere to each other. The bias members allow the article to pass between the bias members and bias the self-adhering bag into contact when the article is no longer between the bias members. A self-adhering bag may also have a reduced-cross-sectional portion (e.g., a tube) that opens and/or expands to allow passage of articles into a larger portion of the bag for storage of the articles. The reduced-cross-sectional portion closes after passage of the articles to inhibit odors from exiting the larger portion of the bag. A self-adhering bag may be configured with a flap that pivots to allow articles into the bag and that is biased shut to self-seal the bag. Embodiments of the invention preferably can be attached to existing devices, such as trash receptacles, to help contain odors. Embodiments of the invention may combine various aspects described. For example, a other container may have a tube, a flap, or one or more bias members for making an odor-resistant seal, or the container may have combinations of these features. Other embodiments are within the scope of the invention.

Bags used in embodiments of the invention are preferably, but not necessarily, configured to be self-sealing. For example, plastic bags may be provided with adhesive and/or static-inducing additives or coatings, or at least not provided with slip agents or anti-static additives or coatings. The bags may be configured to allow selective attachment, e.g., selective static bonding such that bags may seal automatically and be repeatedly opened and resealed. Bags, however, need not be self-sealing, e.g., with embodiments where portions of bags are biased against each other. Further, self-sealing as used in this description does not require perfect sealing. Bags are preferably made of materials that provide vapor and/or liquid barriers to inhibit passage of liquids and gases through the materials.

Figure 1:
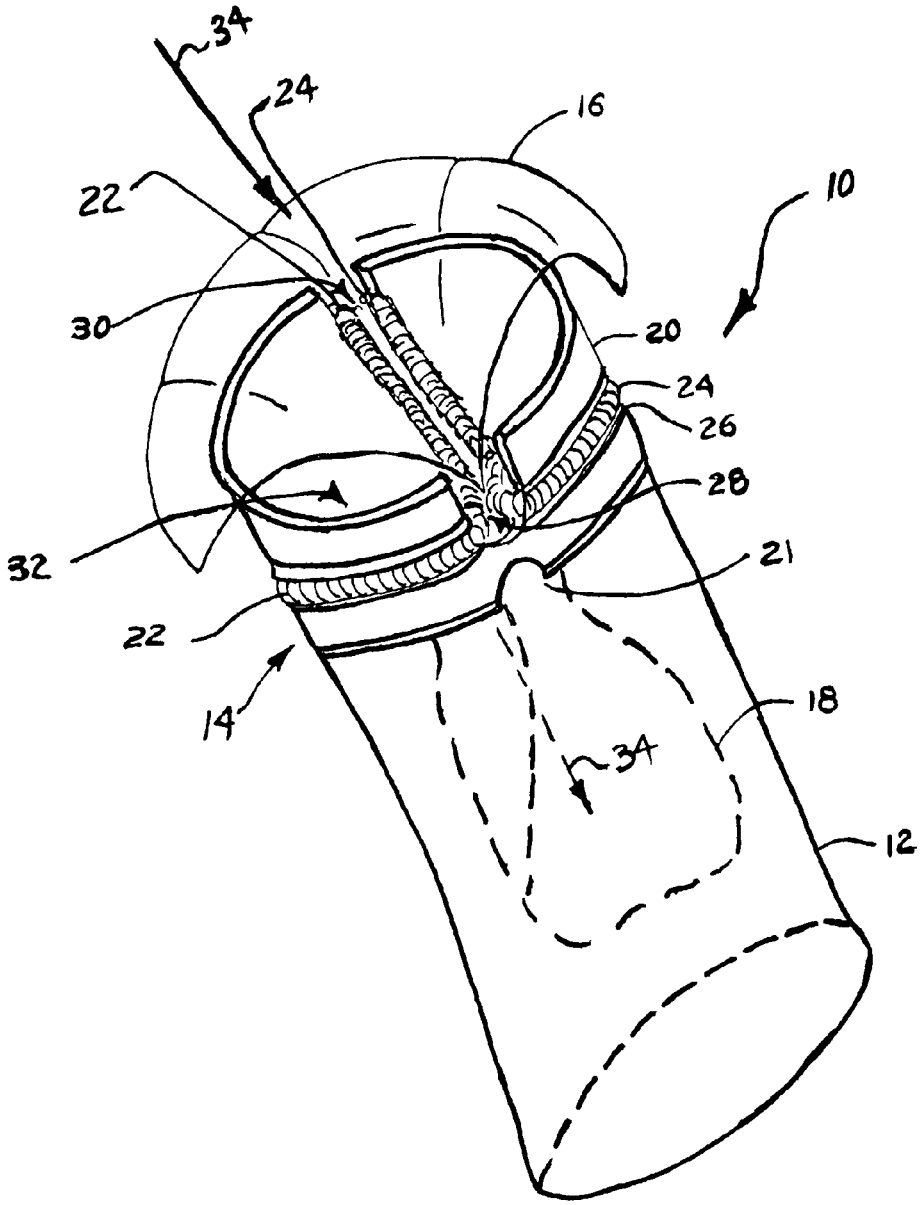
FIG. 1 is a perspective view of an odor-containing system.

Referring to FIG. 1, an odor-containment system 10 includes a receptacle 12, a closure device 14, and a bag 16. The bag 16 is shown partially cut away in FIG. 1 for clarity. The receptacle 12 is a configured to contain and store articles that are inserted into a lower portion 18 of the bag 16, disposed in the receptacle 12, through the closure device 14. For example, the receptacle may have a capacity of about 15 gallons, although this size is exemplary only, and not limiting of the invention. The receptacle 12 and/or the closure device 14 may be scented to provide a pleasant smell. The bag 16 is configured to loop over a top edge of the closure device 14 to hold the bag 16 and support articles deposited into the bag 16. The bag 16 preferably has a tensile strength sufficient to allow a person to pick the bag 16 up from its top with the bag 16 full of typical household waste without the bag 16 tearing.

The closure device 16 is configured to close the bag 16 to inhibit odors from articles disposed in the lower portion 18 of the bag 16 from escaping from the bag 16. The device 16 is configured to push portions of the bag 16 against each other to close off the bag 16. Here, the device 16 includes a body 20 and two bias members 22, 24, here coil springs. The body 20 provides a groove 26 around its perimeter for retaining the coil tension springs 22, 24 in place. The body 20 also provides two notches or slots 28, 30 on opposite sides of the body 20 and through which the springs 22, 24 can pass. The springs 22, 24 are disposed next to each other in a passageway or throat 32 provided by the body through which articles may be inserted. The springs 22, 24 provide a slit through which articles may be inserted. The springs 22, 24 will deflect outwards away from each other as an article is passed between the springs 22, 24 through the passage 32, e.g., in a direction indicated by arrow 34. The resilient biases of the bias members 22, 24 cause the members 22, 24 to move inwardly and return to their original positions next to each other after the article has passed between the bias members 22, 24, closing the bag 16. Items may be attached to the bias members 22, 24, such as foams or elastomers to help seal the bag 16.

The closure device 16 may be used with receptacles not specifically designed to be used with the closure device 16, as the device 16 is preferably configured to fit onto existing receptacles, e.g., trashcans. The body 20 may be configured to rest on or otherwise attach to various sizes of cans. A notch 21 is provided in a bottom of the body 20 that is adapted to fit a trashcan or other container to hold the bag 16. Alternatively, or additionally, the body 20 may have a lip around its bottom edge for resting on the receptacle 12. The closure device 16 may be configured to have a single body fit onto multiple sizes and/or shapes of receptacles. Preferably, however, different bodies 20 having different shapes and/or sizes would be used for different sizes and shapes of receptacles. The body 20 shown in FIG. 1 is a ring with a circular shape configured to mount to circular-topped receptacles. Thus, the groove 26 is a circumferential, annular groove, and the slots 28, 30 are diametrically opposed.

The bag 16 is preferably made of a material or materials that will allow the bag 16 to attach to itself, or not inhibit attaching to itself. For example, the bag 16 may be configured with materials such that the bag 16 will adhere to itself where pushed into contact with itself by the bias members 22, 24 to inhibit gas from exiting from the lower portion 18 of the bag 16. The bag 16 may attach through various mechanisms such as static electricity cling. Thus, the bag may be a thin film plastic that includes adhesive and/or static-inducing materials, and/or has an adhesive and/or static-inducing coating. The adhesives may function as a permanent or non-permanent bonding mechanism. The bag 16 material is preferably configured such that the bag 16 will be adhered temporarily in a selected area to provide a temporary air seal once a product passes through that region, and to allow re-opening of the temporary seal.

The bag 16 may be made from materials from various resources and may have a range of physical properties. Cellulose and natural fiber materials (paper and related products) may be used and provide environmentally friendly properties and manufacturing flexibility. The bag 16 may be an ethylene (olefin) material, and may include a layer of semi rigid material such as polyester.

Various plastics may be used for the bag 16. Plastics are processed from natural resources and can be formed, molded and extruded into many shapes, such as flexible plastic films. Films are typically found in gauge thickness up to about 10 mils. These films can offer various properties and combinations of materials can be customized to offer several combined properties to provide desired odor containment and strength for supporting contained articles. Olefin resins are desired for films due to the low cost and versatility to process. Flexible and semi flexible plastic films can be made from Linear Low Density Polyethylene (LLDPE), Low Density Polyethylene (LDPE), High Density Polyethylene (HDPE), Polypropylene (PP), Polystyrene (PS), Polyvinyl Chloride (PVC) and nylon and polyester. LDPE offers features such as resistance to gas permeability and helps prevent the transfer of oxygen and odors. HDPE is stiffer than LDPE and can be extruded in a thinner gauge and hold a shape, thus possibly making an HDPE bag more economical due to weight, thickness, and cost per pound.

Flexible films can be made with various physical properties and configurations. These films may be extruded in colors (solid or tinted), made with additives, and can be made with multiple layers. Additives or plastic agents may be used (e.g., embedded in materials) to improve or modify material characteristics. These processes and additives can improve strength, reduce or induce static, lubricate, provide aromatic scents that can be useful in providing pleasant smells, etc. Polypropylene (PP) film has excellent moisture barrier characteristics and can be co-extruded or laminated with other materials to offer a good odor barrier (e.g., with polyethylene/PE). A combination of enhancing processes may be used such as coatings with acrylic, cellulose and/or adhesives that can be selectively coated on plastics to help contain odors from reaching the surrounding environment. Polyester (PET) plastic films have good barrier, thermal, mechanical and toughness properties. A laminated or co-extruded material with a small-gage thickness would offer a good odor containment material, especially when processed with polyethylene materials. PVDC (i.e., Saran Wrap®) could be used as it has excellent moisture and gas barrier properties. Also, PVDC can be combined (extruded or laminated) with other films such as PP to offer both good toughness and an excellent odor barrier. Films for use as the bag 16 preferably have thicknesses of less than about 0.010" and more preferably between about 0.0005" and about 0.003".

Flexible plastics can be combined with other materials such as paraffin or wax coatings, paper, foils, and baking soda. The density and thickness of plastic and similar films affect water vapor transmission and physical properties of the films. The bag 16 may be made from multi-layer or single-layer extruded film, and may include coatings or other additives to inhibit water or gas from passing through the film. Anti static additives or agents that are commonly used with slip agents to improve processing and handling of the materials may not be used when making the bag 16, e.g., to help the bag 16 attach to itself.

Figure 9:
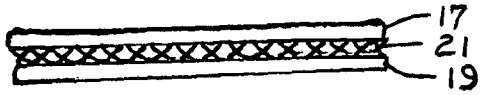
FIG. 9 is a side view of a laminated or co-extruded material with outer layers and at least one inner layer of material.

Referring to FIG. 9, the bag 16, or bags or films used in other embodiments of the invention, may include multiple layers of materials, and may include odor-reducing materials between layers. Here, the bag 16 includes outer layers 17, 19 and an inner layer 21. The inner layer 21 may be an aromatic additive or odor-neutralizing additive for long-term odor reduction. Also, baking soda or a statically-charged or static susceptible material can be added to the internal layer 21 to assist in keeping sealing the bag 16. Anti-bacterial additives may also be used. Further materials could be used in the inner layer 21 to reduce odor, e.g., that incorporate heat or mechanical micro-encapsulated materials. Additionally, the outer layers 17, 19 may be made to include graphics or other coloring, e.g., by printing on the layers 17, 19 and/or embedding coloring in the layers 17, 19.

The bag 16 may be made from materials that take into account that today's society is concerned with using recyclable materials in both consumer and industrial applications. There are several plastic films that can be processed in a single layer or multiple layers for product applications. Paper can be coated or processed with ethylene to provide a barrier while being environmentally friendly.

Co-extrusions may use one or more dies to process the film. An extrusion process to manufacture the film may include slitting or sizing of the material and even producing the actual bag 16, e.g., for economical reasons.

Figure 2:
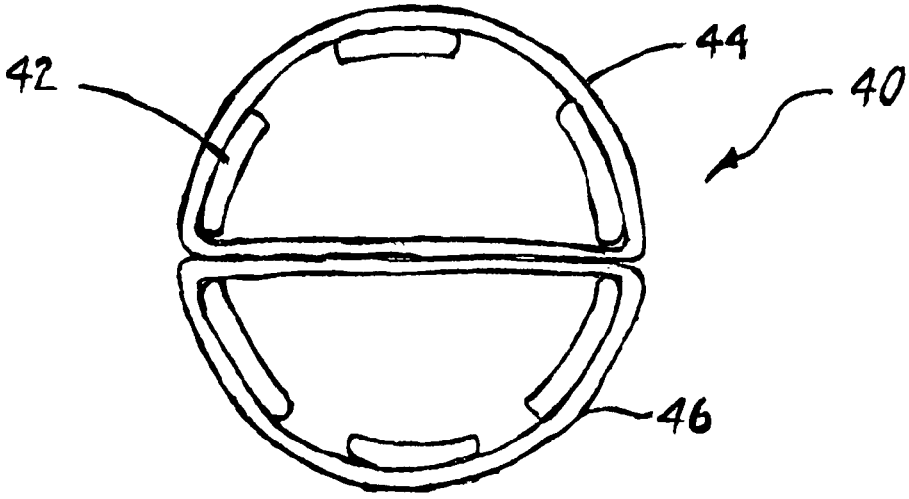
FIGS. 2-3 are top views of other odor-containing devices.
Figure 3:
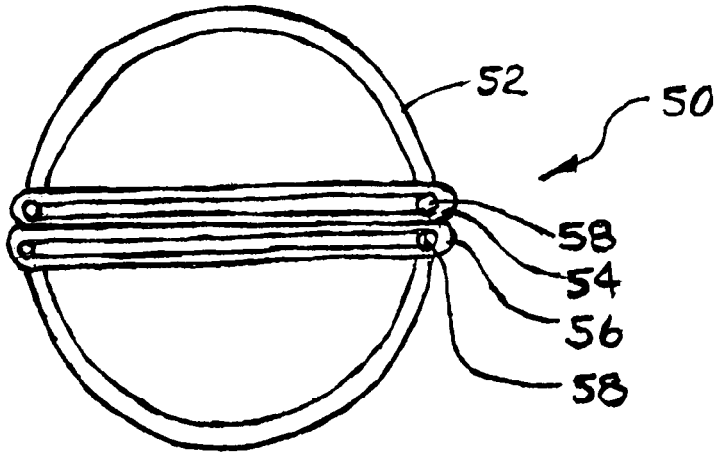
Figure 4:
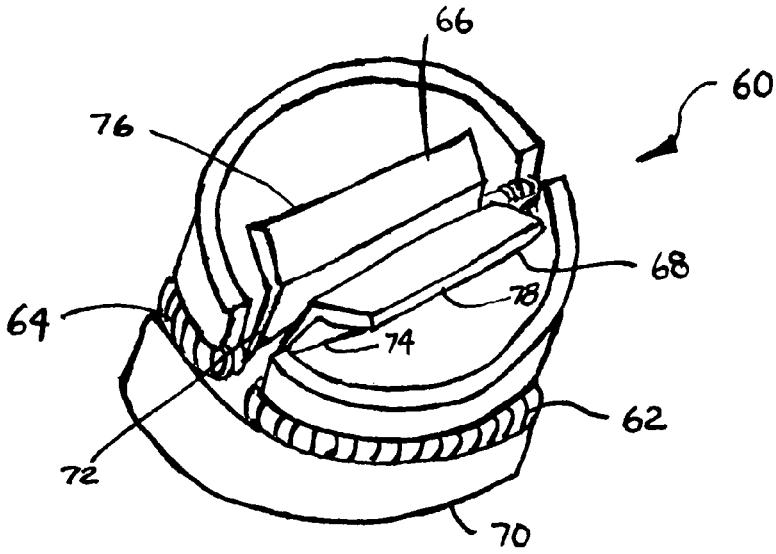
FIG. 4 is a perspective view of another odor-containing apparatus.
Figure 5:
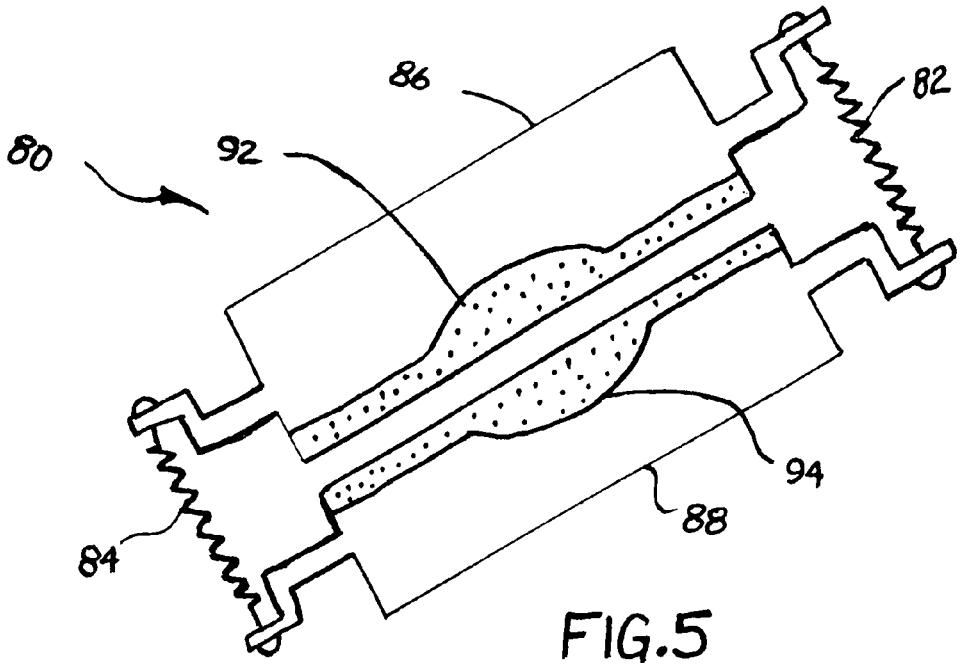
FIG. 5 is a simplified top view of a closure mechanism for use in odor-containing apparatus.

Various alternatives are possible for the configuration of the closure device 16. For example, configurations other than that shown in FIG. 1 may be used. Also, bias members could overlap along the direction of insertion 34 of articles. Instead of the bias members 22, 24 being loops, they could be open-ended springs with their ends attached to opposite sides of the body 20. Referring to FIG. 2, a closure device 40 includes a body 42 and two bias members 44, 46. The body 42 is configured similarly, but not necessarily identically, to the body 20 shown in FIG. 1. The bias members 44, 46 are elastic, stretchable bands configured for extensive, repetitive expansion. Referring to FIG. 3, a closure device 50 includes a body 52 and two bias members 54, 56. Here, the bias members 54, 56 are elastic loops that are looped around posts 58 disposed at opposite sides of the body 52. Referring to FIG. 4, a closure device 60 includes two bias members 62, 64, two blades 66, 68, and a body 70. Each of the bias members 62, 64 loop around opposite outside portions of the body 70 and attach to opposing ends of the blades 66, 68, respectively. The blades 66, 68 are preferably made of a flexible material such as rubber. The blades 66, 68 have angled cross-sections such that lower portions 72, 74 are disposed adjacent each other to close a bag inserted between the blades 66, 68 in a closed position. Upper portions 76, 78 angle away from the lower portions 72, 74 at an obtuse angle to facilitate inserting articles through the blades 66, 68 into a receptacle. The blades 66, 68 can bend outwardly, and the bias members 62, 64, here springs, can extend to allow the blade ends to move inside the body 70 to further facilitate insertion of articles between the blades 66, 68. The members 62, 64 bias the blades 66, 68 closed when the article has passed between the blades 66, 68. Alternatively, the blades 66, 68 could be pivotally connected to the body 70 and not attached to bias members. Referring to FIG. 5, a closure mechanism 80, that can be used with a closure device body (not shown), includes two bias members (here coil tension springs) 82, 84, and two blades 86, 88. Each of the springs 82, 84 biases corresponding ends of the blades 86, 88 toward each other. The blades 86, 88 may be made of various materials such as plastic, rubber, or foam, or, as shown, made of plastic with foam inserts 92, 94 that are disposed on adjacent edges of the blades 86, 88 and that are larger in the middle of the blades 86, 88.

Figure 6:
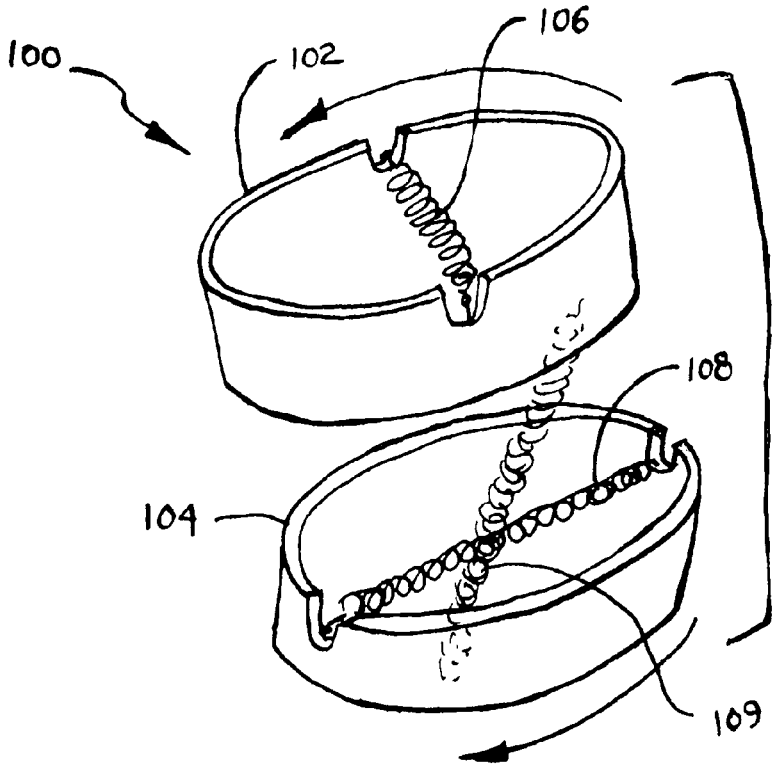
FIG. 6 is a perspective of a rotating odor-containment mechanism.
Figure 7A:
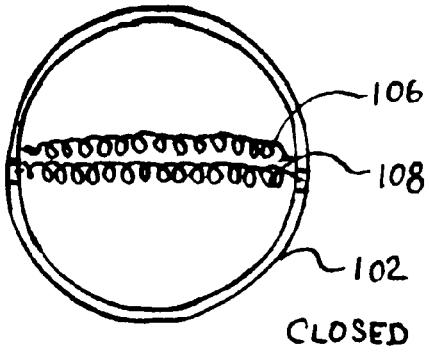
FIGS. 7A-7B are top views of the mechanism shown in FIG. 6 in closed and open position, respectively.
Figure 7B:
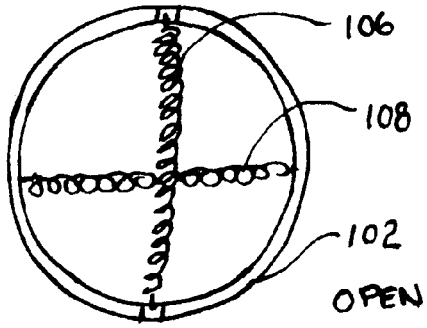

Referring to FIGS. 6-7, a closure mechanism 100 includes two discs 102, 104 and two bias members 106, 108. The discs 102, 104 provide a tubular shape (although not necessarily round) and are configured and coupled to rotate relative to each other between a closed position shown in FIG. 7A and an open position shown in FIG. 7B. In the closed position, a bag disposed between the bias members 106, 108 is squeezed shut and when the discs 102, 104 are rotated relative to each other the bag partially opens, allowing articles to be placed in the open portion of the bag. A spring or similar mechanism 109 is connected to the two discs 102, 104 to bias the discs toward the closed position such that the discs 102, 104 will rotate closed automatically, sealing the bag.

Figure 8:
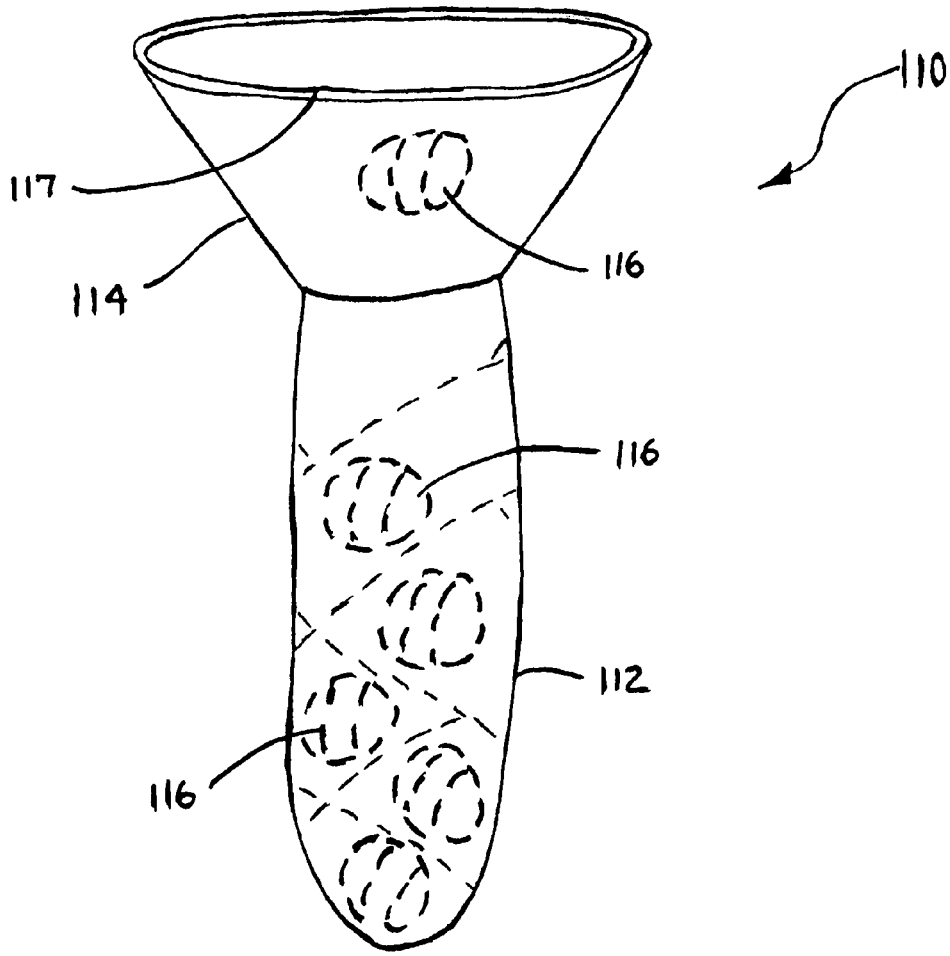
FIG. 8 is a side view of a stretchable film odor containment apparatus.

Referring to FIG. 8, a disposable odor containment bag 110 includes a tubular-shaped piece of self-adhering/self-sealing material. For example, the material may be PVDC, or similar material. The material of the bag 110 may include additives and/or agents that induce self-sealing such as adhesives, and/or may be made without using slip agents or anti-static agents. The bag 110 preferably has a tubular shape in a storage portion 112 and a frusto-conical shape in a receiving portion 114. The bag 110 may have a reinforcement 117 connected to the rest of the bag 110 and disposed at the open end. The reinforcement may be, e.g., a reinforcing loop (e.g., a ring or other shape) that may be a thicker portion of the material comprising the remainder of the bag 110, or may be a different material (e.g., a rigid or semi-rigid material). The material of the bag 110 is configured to have at least the storage portion 112 stretch and attach to itself as articles 116 are deposited into the bag 110. Thus, articles 116 put into the receiving portion 114 pass into the storage portion 112, causing the storage portion 112 to stretch to accommodate the articles 116, and to attach to itself above each article 116, e.g., by adhesion, by static cling, etc. The storage portion 112 attaching to itself inhibits odors from the articles 116 exiting back through the receiving portion 114.

Figure 10:
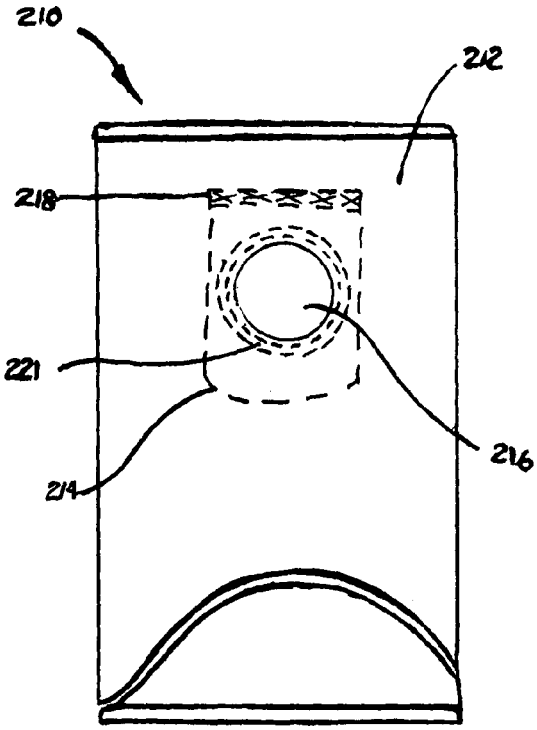
FIG. 10 is a front view of an odor-containment apparatus with an orifice flap seal.
Figure 11:
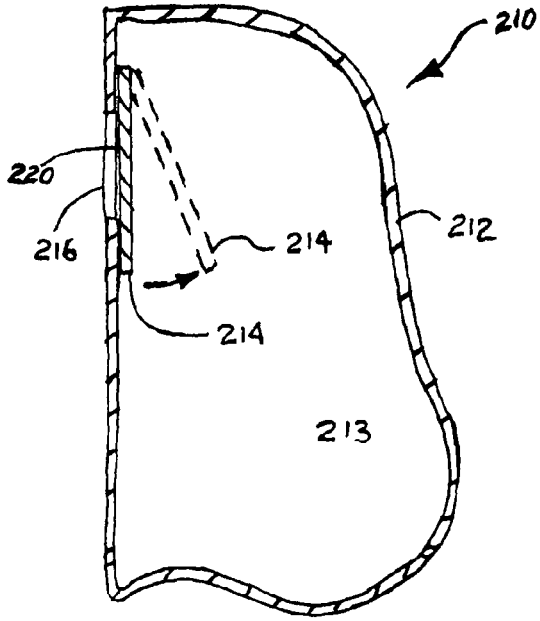
FIG. 11 is a side cross-sectional view of the apparatus shown in FIG. 10.

Referring to FIGS. 10-11, a disposable odor containment apparatus 210 includes a bag 212 and a flap 214. The bag 212 is preferably made of a thin plastic film that may include layers of materials, e.g., odor-concealing scented materials, materials that absorb odors, etc. The bag 212 may be flexible, rigid, semi-rigid, or combinations of these (e.g., flexible in parts and semi-rigid in other parts). The materials of the bag 212 on the inside of the bag, at least in a region that is contacted by the flap 214, and the flap 214, at least on a surface that contacts/touches the bag 212, are configured to attach to each other. For example, the bag 212 and the flap 214 may have adhesive coatings, or may be statically charged, etc. A surface 220 of the flap 214 may have a laminated soft surface or an adhesive coating, etc., to help the flap 214 attach to the bag 212 to seal odors inside the bag 212. The flap 214 is preferably made of a rigid or semi-rigid material, but may also be a flexible material such as a film. The flap 214 is pivotally attached to the bag 212 at a top of the flap 214 along a pivot line 218. For example, the flap 214 may be glued or welded to the bag 212. The bag 212 provides an opening 216 and the flap 214 is connected to the bag 212 in alignment with the flap 214. The opening 216 and the flap 214 are positioned and sized such that the flap 214 completely covers the opening 216 with the flap in the closed position shown in solid lines in FIG. 11. The flap 214 can pivot to an open position shown, in phantom in FIG. 11 when pushed, allowing articles to be placed inside the bag. Gravity causes the flap 214 to return to the closed position, with the flap 214 attaching to and sealing the bag 212 when the flap 214 returns to the closed position and contacts the bag 212. A gasket 221, e.g., made of rubber, may be provided in the area of the window 216 for making a seal with the flap 214. The apparatus 210 can be configured with the bag 212 having an open-ended portion that extends down into a receptacle area 213, as described below with respect to, e.g., FIG. 16. Also, a stiffener 219 may be included with the flap 214. The stiffener 219 may be, e.g., a thin piece of semi-rigid plastic and may be attached to the outside of the flap 214 or embedded in the flap 214.

Figure 12:
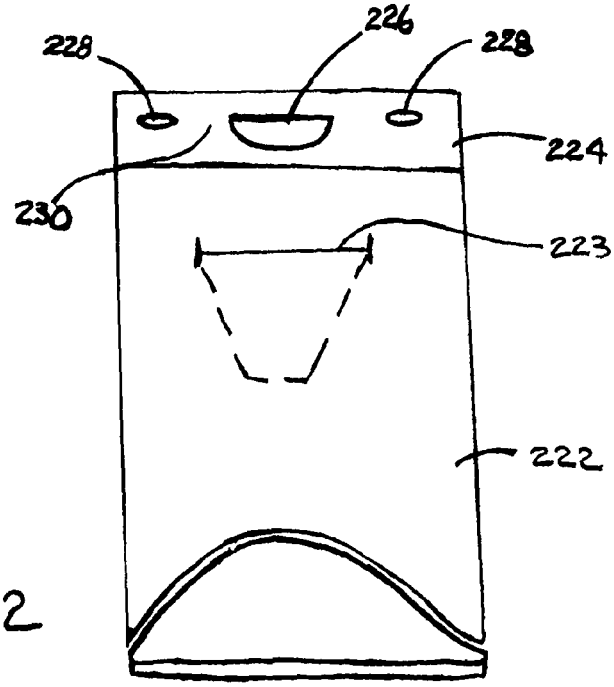
FIG. 12 is a front view of an odor-containment apparatus with a slit opening, internal flap seal, and a handle/mounting portion.

As shown in FIG. 12, a disposable apparatus 222 similar to the apparatus 210 shown in FIGS. 10-11, includes a handle/mounting portion 224. The portion 224 provides openings 226, 228 that provide mechanisms for carrying and mounting the apparatus 222. The opening 226 provides a handle 230 for grasping by a person when using or transporting the apparatus 222, e.g., to deposit articles in the apparatus 222 or to take the apparatus 222 to a trash repository, respectively. The openings 228 provide mounting holes for mounting the apparatus 222, e.g., to a wall, in a car, to a crib, etc. The apparatus 222 includes a slit opening 223 for receiving articles and an internal flap for sealing the slit 223.

Figure 13:
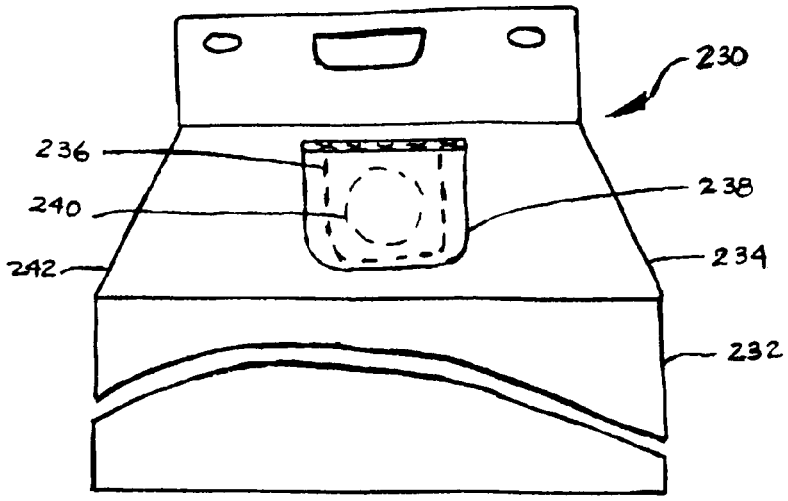
FIG. 13 is a front view of an odor-containment apparatus with a dual orifice flap seal.
Figure 14:
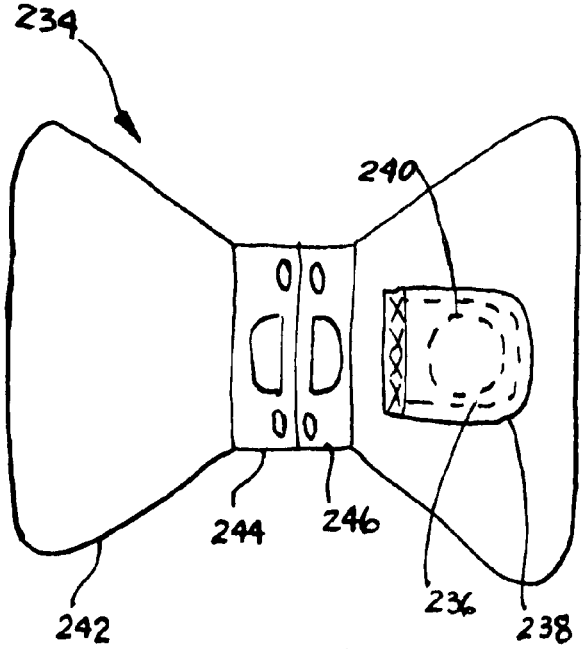
FIG. 14 is a top plane view of an orifice flap seal and handle of the apparatus shown in FIG. 13.
Figure 15:
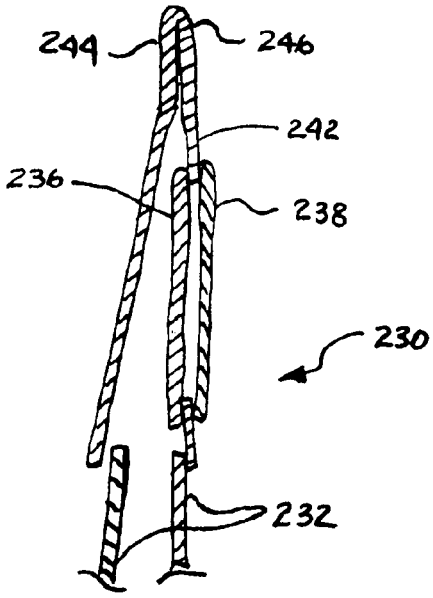
FIG. 15 is a side view of the odor-containment apparatus shown in FIG. 13.

Referring to FIGS. 13-15, a disposable odor-containment apparatus 230 includes a bag 232 and a sealing mechanism 234. The sealing mechanism 234 is configured similarly to the apparatus 222 shown in FIG. 12, except that the sealing mechanism 234 includes multiple sealing flaps 236, 238. The flaps 236, 238 are both configured to cover a window 240 provided in a body 242 of the sealing mechanism 234. The flaps 236, 238 are pivotally attached to the body 242. The body 242 is attached to the bag 232, e.g., by welding. Referring to FIG. 14, the sealing mechanism can be produced by forming a single piece of thin film for the body 242, cutting out desired openings (e.g., to provide mounting holes and/or a handle), and attaching the flaps 236, 238. The body 242 can be folded and upper portions 244, 246 with mating openings fused together.

Figure 16:
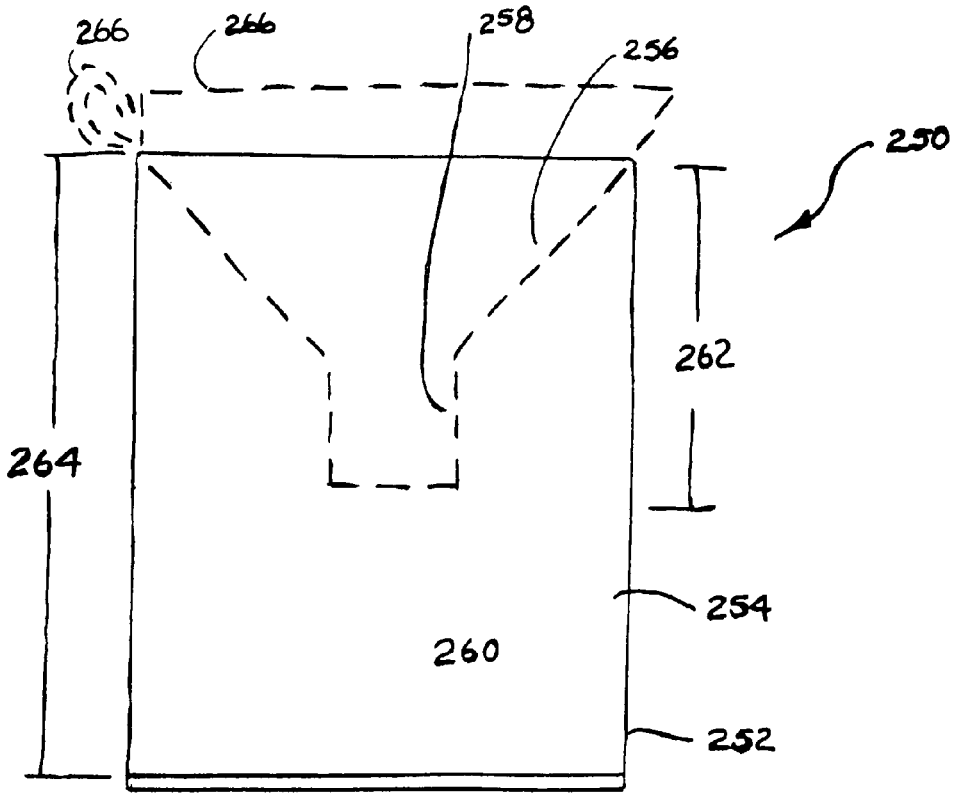
FIG. 16 is a side view of another odor-containment apparatus.

Referring to FIG. 16, a disposable odor-containing apparatus 250 comprises a bag 252 that extends inside itself. The bag 252 includes an outer storage portion 254, a receptacle portion 256, and an inner, reduced-cross-section portion 258. The receptacle 256 and inner portion 258, as shown, have a funnel shape. The inner portion 258 may have a variety of cross sections such as relatively flat, or tubular, etc. The inner portion 258 has a cross-sectional area when open of a size for receiving typical waste items. The inner portion 258 is preferably; configured to allow passage of articles into a storage area 260 of the storage portion 254, and to close upon itself and seal when no articles are disposed within the inner portion 258. For example, the bag 252 may be made of a single unit of flexible plastic film, that may be one or more layers of material, with at least the inner portion 258 being configured to self-seal, e.g., statically charged or coated with an adhesive or similar coating. One or more obstructions may disposed in the inner portion 258 to help seal the inner portion 258 and/or otherwise inhibit odors from the storage area 260 escaping the bag 252 through the inner portion 258. The receptacle portion 256 and the inner portion 258 preferably have a combined length 262 that is about one-fourth, or less, of an overall length 264 of the bag 252. The bag 252 may be provided with one or more attaching devices 266, such as loops or frusto-conical extensions from the bag 252 to attach to a supporting mechanism, e.g., a trash can, e.g., with the bag 252 extending into the can.

Figure 17:
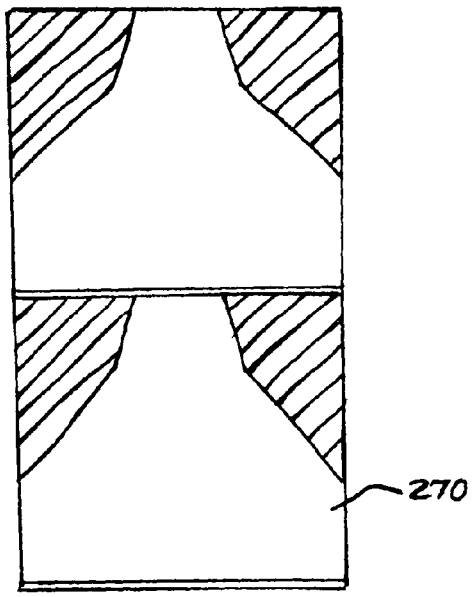
FIG. 17 is a top view of manufacturing material showing a pattern and yield of the odor-containment apparatus shown in FIG. 16.
Figure 18:
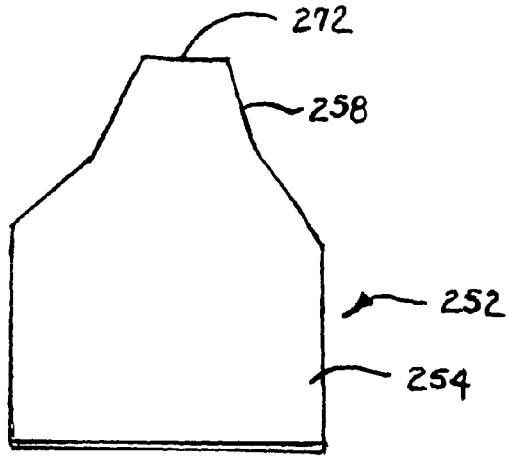
FIG. 18 is a side view of the die-cut and finished odor-containment apparatus shown in FIG. 16.

Referring also to FIGS. 17-18, the bag 252 may be made by cutting and connecting, e.g., welding, plastic film. Material 270 may be cut to form the bag 252. The bag 252 is formed, e.g., by welding portions of plastic film, and cut, leaving the bag as shown in FIG. 18 in an extended position. An end 272 of what is to be the inner portion 258 is preferably not connected e.g., welded, and if it is, then the end 258 is preferably re-opened, e.g., by cutting. With the bag 252 in the extended position shown in FIG. 28, the end 272 is folded or pushed into the storage portion 254 such that the bag 252 is in the ready position shown in FIG. 16. The bag 252 could be printed and made from a simple converting process.

Figure 19:
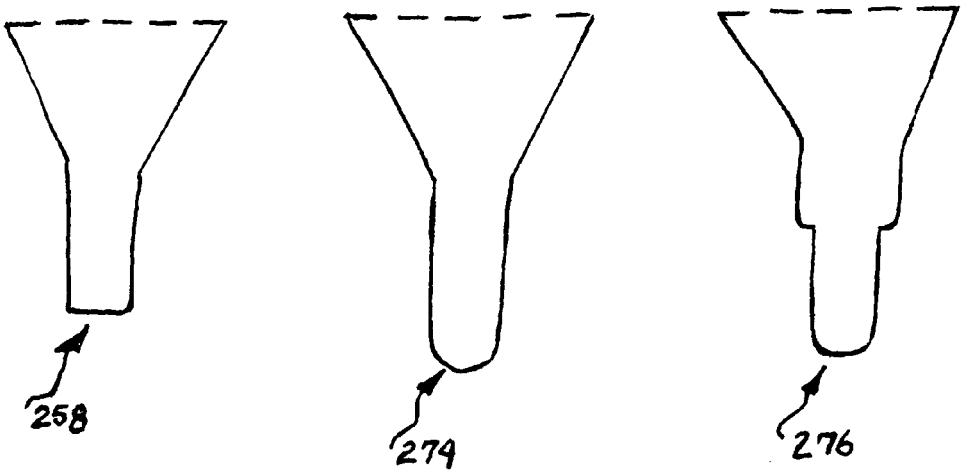
FIG. 19 are side views; of different shapes for a tube seal of the apparatus shown in FIG. 16.

The inner portion 258 of the bag 252 could have various shapes and configurations. Referring also to FIG. 19, the inner portion 258 could have various cross sections, a uniform or non-uniform cross-section throughout its length, etc. For example, the inner portion 258 has a uniform cross-section over its length and a square end. An alternative inner portion 274 has a uniform cross-section and a curved end. Another inner portion 276 has a stepped, non-uniform cross-section and a rounded end. Other shapes and configurations are possible and acceptable. The round ends of the inner portions 274, 276 can be processed with a rigid or semi-rigid material co-extrusion. Any of the inner portions may have a slit or other opening along its length.

Figure 20A:
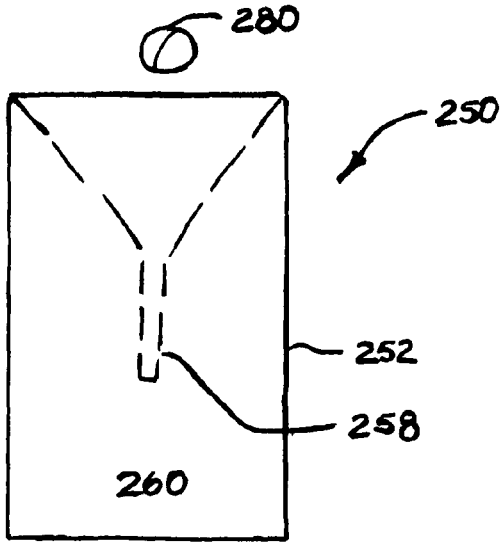
FIGS. 20A-20C are side views of the apparatus shown in FIG. 16 in use for receiving and storing odor-producing articles.
Figure 20B:
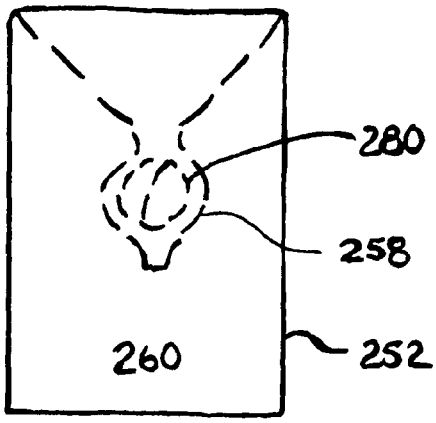
Figure 20C:
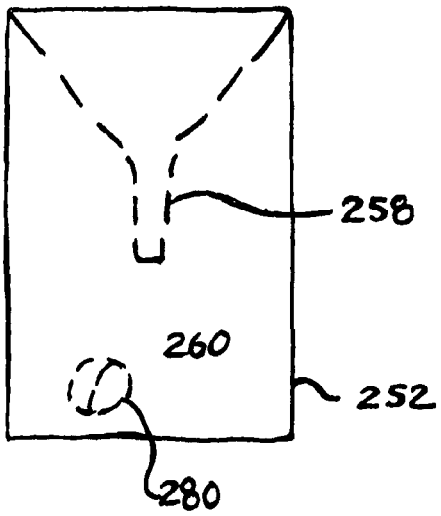

Referring to FIGS. 16 and 20A-20C, the bag 252 is configured to receive articles 280 and to self-seal to inhibit odors from the articles 280 from exiting the bag 252. As shown in FIG. 20A, in its normal, resting, receiving position, the inner portion 258 is substantially closed (e.g., if the inner portion 258 is flat, then FIG. 20A would be a side view of the inner portion 258). As the article passes through the inner portion 258, shown in FIG. 20B, the inner portion 258 opens to accommodate the article 280. As the article 280 passes into the storage area 260 of the bag 252, as shown in FIG. 20C, the inner portion 258 closes on itself and seals, inhibiting odors from the article 280 from passing back through the inner portion 258 and out of the bag 252.

Figure 21:
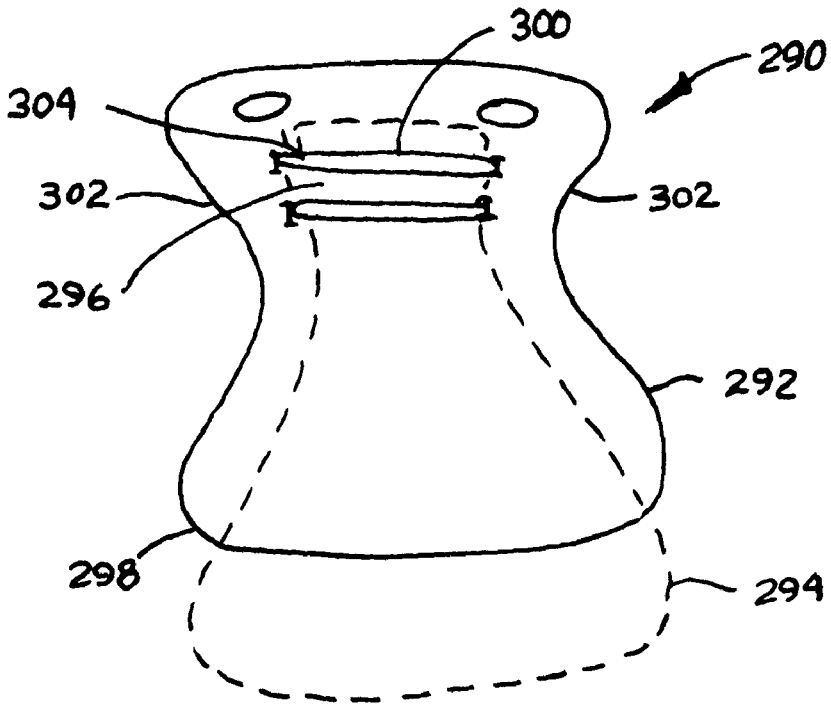
FIG. 21 is a front view of a one-piece die cut spring member to hold and seal a bag.

Referring to FIG. 21, an odor-containment system 290 includes a sealing mechanism 292 and a bag 294. The sealing mechanism 292 is a resilient material with spring characteristics (e.g., a PP board). The sealing mechanism 292 includes a tensioning member 296 that is connected to a body 298 of the sealing mechanism 292. The member 296 may be a portion of the body 298 and formed by cutting slits 300 in the body 298. The bag 294 is fed through the slits 300 with the tensioning member 296 providing tension on the bag 294 to seal the bag 2941. The body 298 of the sealing mechanism 292 may be squeezed, e.g., at points 302, on opposite sides of the body 298 in line with the tensioning member 296 to force the member 296 away from the body 298 to a open a passage 304 between the member 296 and the body 298 to allow an article to be placed inside the bag 294. Releasing the body 298 will allow the spring bias of the material to return the sealing mechanism 292 to its resting state, with the tensioning member 296 sealing the bag 294.

Figure 22:
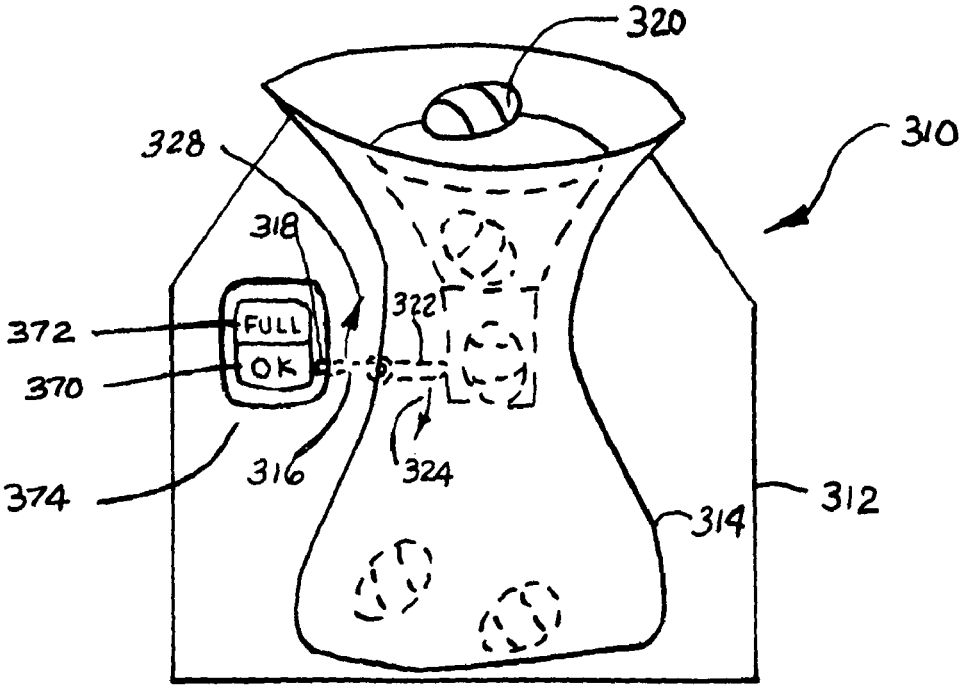
FIG. 22 is a perspective view of an odor-containment apparatus that includes a visual fullness indicator.

Referring to FIG. 22, an odor-containment system 310 includes a container 312, a bag 314, and a fullness indicator 316. The bag 314 may be any of a variety of bags, e.g., similar to the bag 252 shown in FIG. 16. The fullness indicator 316 is preferably of a simple design, here comprising a detector/indicating arm 318 pivotally connected to the container 312. When articles 320 fill the container 312 sufficiently, a detecting portion 322 of the arm 318 is pushed outwardly as indicated by arrow 324. This causes an indicating portion 326 to movie upwardly as indicated by arrow 328. The indicator portion 326 thus moves from pointing to an OK/not full indication 370 to pointing to a FULL indication 372. The indications 370, 372 can take various forms, such as text, and/or colors (e.g., green text or background for OK, and red or yellow text or background for FULL), visible through a window 374. More indications may be provided, e.g., an indication between OK and FULL.

Figure 23:
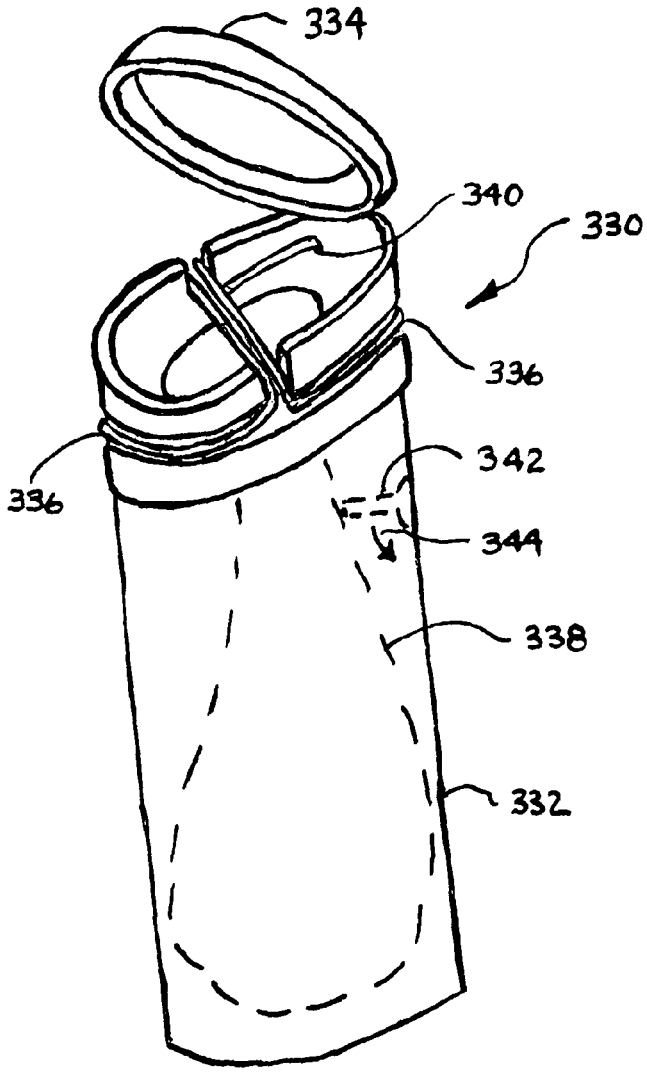
FIG. 23 is a perspective view of another odor-containment apparatus.

Referring to FIG. 23, an odor containment system 330 may comprise a housing 332, a cover 334, spring bias resilient members 336, and a flexible material (e.g., a bag or pouch) 338 (shown only in the housing 332). The system further includes an actuator 340 configured to move, here separate, at least one of the resilient members 336 to release an article to be disposed of into the main body of the flexible material 338. The actuator 340 may be configured to move the resilient member 338 in response to the cover or lid 334 being opened, or in response to actuation by a user, e.g., with the cover 334 open. The system 330 may also contain a pivot arm 342 that can support articles in the housing 332 while the lid 334 is open, and release the article into the lower portion of the housing 332 when the lid 334 is closed as indicated by an arrow 344.

Other embodiments are within the scope of the invention and the appended claims. For example, while many embodiments of the invention are preferably configured to be disposable, they may be configured to be reusable. Disposable embodiments of the invention may be relatively small, e.g., with lengths of about 12 inches or less (e.g., the apparatus 222 shown in FIG. 12 or the system 230 shown in FIG. 13. Further, referring to FIG. 10, the flap 214 may be an interior wall of the bag 212. For example, the flap 214 may be made of the same material as the bag 212, extend the width of the bag 212, and be pivotally connected to the bag 212 along the end of the bag 212. Thus, if the bag 212 is made of two layers that are connected, e.g., welded, along the end of the bag 212, then the flap 214 may be a third layer, that is shorter than the bag 212, that is welded between the two outer, layers along the top end of the bag, or at least above the window 216. Further, while bag materials have been described as possibly not having slip agents or other materials that would inhibit attaching of the bags to themselves, and/or help the bag slide over itself, some amount of slip agents or other such materials may be used in the bags, e.g., to help the bags open to allow passage of articles through the bags, e.g., through tubes in the bags, yet allow the bags to seal. Also, a single bias member such as an elastic loop mats be used, e.g., in, the device 50 shown in FIG. 3, to provide a biased seal for a bag. Adjacent portions of the loop could be separated to allow articles to be passed through the loop), and the loop would return to its original shape when the article has passed, pushing the bag together to touch and reseal.

Still further embodiments are within the scope of the invention and the appended claims. For example, a bag malt have a gusset and have four walls. In this case, the bag preferably has at least one wall with a flap or flat wall of material that provides at least two surfaces that are configured to attach to each other to make a seal. For example, one wall could have a flap or second wall and articles could be deposited between the wall and the flap or second wall, with the wall and the flap or second wall providing an odor resistant seal after deposition of the article.

What is claimed is:

1. An odor-containment system comprising:

a body, configured to hold a flexible bag or like container having an open end and opposite closed end; and a closure comprising a resilient spring like member held in close proximity to the system body, disposed horizontally across the width of the open end of the said body, and when the closure is in a closed position the resilient spring like member seals a portion along the horizontal width of the flexible bag or like container in the proximity of the open end;

wherein the resilient spring like member is configured to be attached to the body of the system, having opposite distal ends spanning across a width of the flexible bag or like container and fluffier configured to be displaced about the midsection of the closure to receive articles within the flexible bag or like container;

wherein the resilient spring like member when in the normally closed position seals the flexible bag like container in the proximity of the open receiving end of the system;

wherein the resilient spring like member is configured to be in a normally closed, sealed position and when an article passing through the open end of the flexible bag or like container the resilient spring like member opens and allows article to pass into the chamber of the flexible bag or like container, and the spring like member to returns to a normally closed position onto the flexible bag or like container sealing undesired odors inside.

2. The system of claim 1 further comprising the flexible bag like container, wherein the container is configured to be manufactured of an environmentally friendly material.

3. The system of claim 2 wherein the flexible bag like container is configured with a combination of at least one of a multi layer of film, co extruded film and visual indicator graphic film.

4. The flexible bag like container of claim 1, wherein the flexible bag like container is configured to at least one of produce an odor-masking scent, absorb odors, and neutralize odors.

5. The system of claim 1 further comprising a fullness indicator.

6. The system of claim 1 comprising the spring like member configured of at least a length of a coil like resilient spring horizontally mounted at opposing ends to the body of the system.

7. An odor-containment apparatus comprising:

a housing configured to receive a flexible bag like container and to dispose and store articles within the body of the flexible bag like container;

a closure device configured to the apparatus comprising a housing body, and a pair of resilient spring like bias members configured to be disposed in close proximity to each other in a passage way provided by the housing body and further include within the spring members and passage the flexible bag like container internally positioned and attached to prevent odor from passing through the bag and receiving end of the apparatus and;

wherein the resilient spring member is configured to be disposed in contact with the housing body, the flexible bag like container and is securely mounted to the apparatus around a portion of the perimeter of the housings; and the odor-inhibiting closure device having a first portion configured to securely fasten to a rigid body, a second portion to move resiliently about a width that is configured to receive the flexible bag like container within the apparatus and provide an opening such that the passage of the flexible bag like container is restricted by the resilient spring like member configured within the closure device and near the receiving end of the apparatus;

wherein the apparatus is configured to repeatedly open and close, to seal the bag thereby inhibiting odors in the flexible bag like container from passing to the environment outside.

8. The apparatus of claim 7 wherein the housing body is configured to adapt to a standard trash receptacle.

9. The apparatus of claim 7 wherein the apparatus is configured to at least one of produce an odor-masking scent, absorb odors, neutralize odors, kill bacteria, and inhibit bacteria growth.

10. The apparatus of claim 9 wherein the apparatus contains material configured to be activated by at least one of heat, pressure, and time to release an odor-masking scent.

11. The apparatus of claim 7 further configured to attach to a rigid body by a handle or mounting portion.

12. The apparatus of claim 7 wherein the housing body and the apparatus is configured with a visual indicia, media and graphics.

13. An odor-containing apparatus comprising: a body configured to seal and store odor-producing articles;

the body comprising a spring like closure securely fastened horizontally to the said body; and a flexible bag like container comprising a first end to receive articles and a second closed end to store odor producing articles;

wherein the flexible bag like container is securely attached to the body of the apparatus, having a passage formed by the spring like closure, sealing the flexible bag at the open end;

the spring like closure when activated opens a passage inside the flexible bag like container allowing articles to be received into the body of the chamber formed by the flexible bag like container; and when the spring like closure is deactivated about the open receiving end the flexible bag is sealed within the apparatus;

wherein odors are inhibited from escaping from an interior of the flexile bag through the receiving end opening and no trash or debris disposed of comes in contact with the apparatus.

14. The apparatus of claim 13 wherein the spring is a coil of spring wire fixedly mounted to the body.

15. The apparatus of claim 13 wherein the spring is removable and replaceable.

16. The apparatus of claim 13 wherein the apparatus is configured with a handle or mounting features.

17. The apparatus of claim 13 wherein the bag is made of environmentally friendly materials.

18. The system of claim 1, is further configured to prevent waste article contact with the body and or spring member when articles pass through the open end of the flexible bag like container.

* * * * *